United States Patent [19]

Riedel

[11] 4,197,663

[45] Apr. 15, 1980

[54] APPARATUS FOR CONTINUOUS PRESSING AND STEAMING OF FABRIC

[75] Inventor: Dieter Riedel, Porta Westfalica, Fed. Rep. of Germany

[73] Assignee: Firma Drabert Sohne, Hanover, Fed. Rep. of Germany

[21] Appl. No.: 944,577

[22] Filed: Sep. 21, 1978

[51] Int. Cl.[2] ..... D06F 69/02; D06F 71/34; D06F 87/00

[52] U.S. Cl. ..... 38/3; 38/11; 38/49

[58] Field of Search ..... 38/2, 3, 11, 1 C, 1 D, 38/49; 34/30

[56] References Cited

U.S. PATENT DOCUMENTS

| | | | |
|---|---|---|---|
| 411,143 | 9/1889 | Gessner | 38/3 |
| 1,945,273 | 1/1934 | Hetzer | 38/49 |
| 2,101,655 | 12/1937 | Shields | 38/3 |

*Primary Examiner*—Louis Rimrodt
*Attorney, Agent, or Firm*—Larson, Taylor and Hinds

[57] ABSTRACT

In an apparatus for the continuous pressing and decatizing of fabric, a pressure belt serves to move a fabric undergoing treatment around a rotatably-mounted and heatable cylinder. The pressure belt directly contacts the fabric to press it against the cylinder. The surface of the pressure belt is arranged to be heated by a heating roller around which the belt passes prior to passage around the cylinder. The cylinder and heating roller can be independently heated to different temperatures to produce a temperature differential across the fabric as it is pressed. As a result, moisture condensation preferentially occurs on one side of the fabric causing luster reduction on that side of the fabric.

9 Claims, 5 Drawing Figures

APPARATUS FOR CONTINUOUS PRESSING AND STEAMING OF FABRIC

BACKGROUND OF THE INVENTION

1. Field of the Invention

This invention relates to apparatus for the continuous pressing and decatizing of cloth, woven and knitted fabrics, and like material.

2. Description of the Prior Art

German Pat. No. DAS 2,456,921 discloses a system for decatizing fabric comprising a rotatably mounted heatable cylinder, an inner back cloth which, prior to passing around the heatable cylinder is led over a steaming section, and an outer runner cloth which presses the back cloth towards the cylinder. The fabric to be treated is passed between the cylinder and the inner back cloth, and the outer runner cloth is constructed as a pressure belt and is under high tensile stress.

This prior art system is advantageous over previously known cylinder presses in that the pressing treatment occurs without stretching giving rise to a considerably improved sewability. The endless back cloth is, for example, made of satin and circulates without slipping with the pressure belt. The back cloth serves two purposes; on the one hand, the very smooth and even surface of the satin back cloth prevents the relatively coarse surface of the pressure belt from being impressed on the surface of the fabric being treated, and on the other hand, the back cloth serves the purpose of expansionless conveying of the fabric through the steaming section and around the cylinder.

However, the insertion of the back cloth between the fabric and the pressure belt raises a number of problems which may only be overcome with difficulty. For example, quite appreciable wear of the back cloth occurs due to the continuous alternation between the steaming action and the intensive pressing action under high specific contact pressure and at temperatures of between 100° C. and 160° C. The additional costs incurred as a consequence of this wear renders the profitability of the whole process doubtful. These additional costs are made up by the replacement cost of the endless back cloth and the costs of changing this endless back cloth, the latter costs being fairly high inasmuch as the guide and tensioning rollers around which the back cloth passes are comparatively heavy rollers and must be disassembled to replace the worn back cloth. Production is obviously stopped during this period, so that further costs are incurred due to loss of production.

Another disadvantage of the back cloth is that the finish on the fabric being treated differs very greatly between a new and a worn back cloth, so that a change in the quality of fabric finish can be observed over the life of a back cloth. Furthermore, the back cloth prevents direct thermal contact between the pressure belt and the fabric and since the back cloth has an insulating action this reduces the fabric temperature which can be achieved.

It is consequently an object of the invention to provide improved apparatus for pressing and decatising fabric. It is a further object of the invention to provide apparatus in which the endless back cloth may be omitted without giving rise to unacceptable stretching of the fabric being treated.

SUMMARY OF THE INVENTION

According to the invention, there is provided in an apparatus for the continuous pressing and decatizing of cloth and fabric material, an arrangement comprising a rotatably mounted, heatable cylinder, first heating means arranged to heat said cylinder, a pressure belt arranged to directly contact material undergoing treatment to press said material around the cylinder, rollers for circulating the pressure belt, and second heating means arranged to heat the pressure belt prior to passage around the heatable cylinder, said heating means being independently controllable whereby to set up a temperature differential across the material as it is pressed between the cylinder and pressure belt.

By setting up a temperature differential across the fabric as it is taken between the cylinder and pressure belt, condensation can be preferentially induced towards one side of the fabric and this damper side of the fabric is found to have reduced surface luster.

BRIEF DESCRIPTION OF THE DRAWINGS

Apparatus embodying the invention and for pressing and decatizing cloth and fabric, will now be particularly described, by way of example, with reference to the accompanying diagrammatic drawings, in which.

DESCRIPTION OF THE PREFERRED EMBODIMENT

Figure 1:
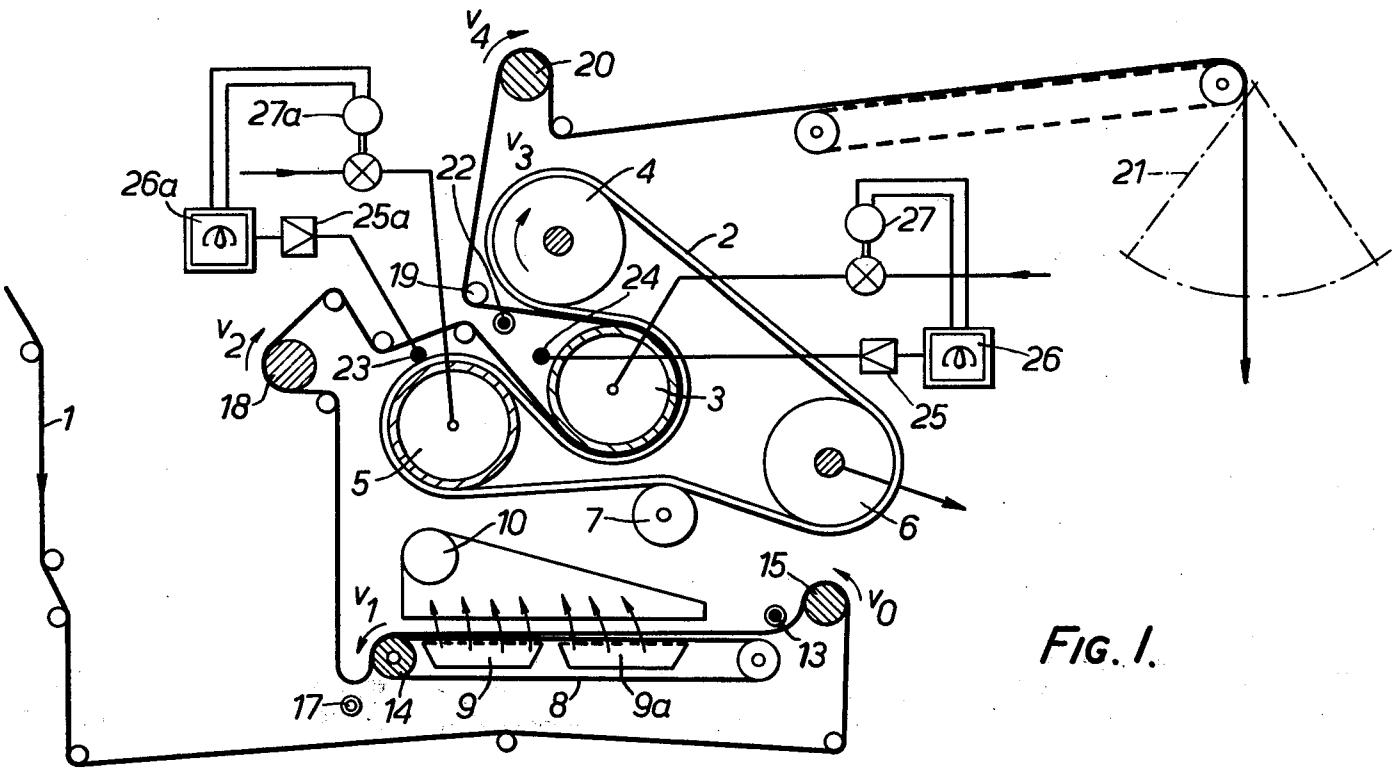
FIG. 1 is a part sectional view of the apparatus including a first form of humidifying device.

As shown in FIG. 1, a fabric 1 undergoing treatment is pressed directly against the surface of a heatable cylinder 3 by means of a pressure belt 2. The surface of the cylinder 3 is highly polished and unscored.

The pressure belt 2 comprises a high-strength carrier element with a coating on both sides having a particularly homogenous, smooth and heatproof surface. The thickness of the coating is substantially greater on the fabric side of the belt.

The pressure belt 2 is passed around rollers 4,5 and 6, the roller 4 serving as a driving roller and the roller 6 serving as a tensioning roller for the pressure belt 2. The roller 5 is heated and serves as a heating roller for heating the pressure belt 2 to a desired temperature for passage around the cylinder 3.

The rollers 5 and 6 and the heatable cylinder 3 are allowed to revolve freely about their axes. A belt control roller 7 is provided to align the pressure belt 2 and ensure that it always circulates centrally.

Prior to undergoing pressing around the cylinder 3, the fabric 1 is subjected to a moisturizing operation on a carrying belt 8, below which are situated several steam chests 9, 9*a* which in the form of moisturizing device shown in FIG. 1 blow steam out upwards.

A suction hood 10 is situated above the carrying belt 8 and communicates with a fan which draws off the steam vapours released.

A feed roller 15 conveys the fabric 1 to the carrying belt 8. The belt 8 is driven by a drive roller 14 which revolves at an automatically controlled peripheral speed $V_1$. Control of the rotational speed of the roller 14 is effected using a non-contact sensor incorporating a photocell or an air reflex nozzle 13 arranged to sense the position of a loop of the fabric 1.

Figure 2:
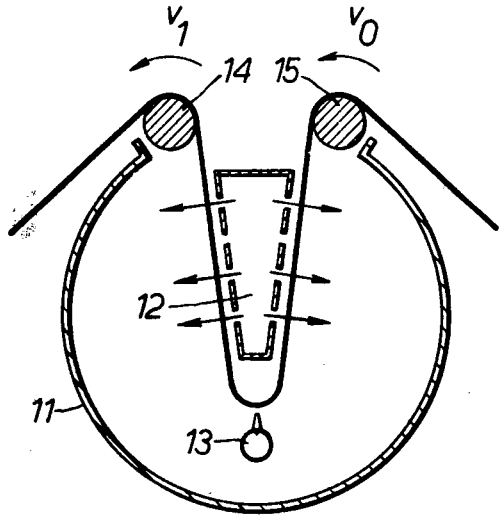
FIGS. 2 and 2*a* are vertical cross-sections through second and third forms respectively of humidifying device for use with the apparatus.
Figure 2A:
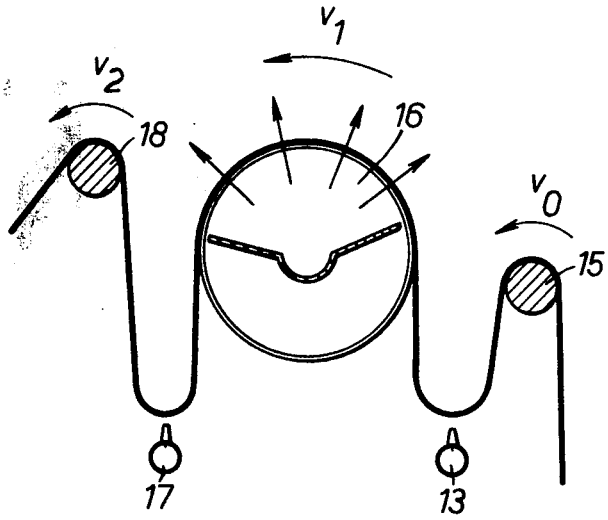

FIGS. 2 and 2*a* show modified forms of the moisturizing device.

In the form of device shown in FIG. 2, the fabric is taken by the carrying belt 8 around a loop lying within a steaming chamber 11. Steam is supplied to the inside of the loop through perforations provided on both sides of a steaming chest 12. The air nozzle 13 monitors the position of the bottom of the fabric loop to control automatic re-adjustment of the peripheral speed of the take-off roller 14 with respect to the feed roller 15.

In the form of the moisturizing device shown in FIG. 2*a* the fabric is taken by the belt 8 around a steaming cylinder 16 which also serves to convey the fabric. The steaming cylinder 16 thus performs the task of the roller 14 shown in FIGS. 1 and 2 and feeds the fabric forward at a speed $V_1$.

Using the described forms of moisturizing device the fabric 1 can be conveyed through the moisturizing device to be moistened without being stretched (indeed, some shrinkage may occur).

Returning to FIG. 1, the moisturizing device is followed by a feed roller 18 driven at a peripheral speed $V_2$. The speed of the roller 18 is controlled automatically by a system arranged to control a variable speed transmission of the roller 18 in dependence on signals received from a non-contact fabric sensor 17 positioned immediately downstream of the roller 14 (or, for the FIG. 2*a* device, downstream of the cylinder 16).

The pressure belt drive roller 4 revolves at a peripheral speed $v_3$ and determines the speed of the pressure belt 2 as well as the actual speed of traversal of the fabric 1 through the pressing means formed by the cylinder 3 and pressure belt 2.

After the fabric 1 has left the pressing means, it is moved by a controllably driven fabric take-off roller 20 over a freely rotatable guide roller 19 and fed to cuttling machine 21. A sensor 22 monitors the fabric 1 to effect automatic re-adjustment of the peripheral speed $v_4$ of the fabric take-off roller 20.

The temperature of the roller 5 is controllable independently of the temperature of the cylinder 3 to enable the surface temperature of the pressure belt 2 to be set as desired relative to the surface temperature of the heatable cylinder 3.

The cylinder 3 and the roller 5 are heated by respective steam heating means, the steam (or other suitable heat carrier) being supplied to these heating means at rates controlled by respective steam volume governors 27 and 27*a*. The governors 27 and 27*a* are in turn controlled by respective temperature regulators 26 and 26*a* which are connected via amplifiers 25 and 25*a* to respective temperature sensors 24 and 23. The sensor 24 is arranged to measure the surface temperature of the cylinder 3 whereas the sensor 23 is arranged to measure the surface temperature of the belt 2 adjacent the cylinder 3.

In operation of the apparatus, the fabric is conveyed through the moisturizing device by the carrying belt 8 and is then taken around the cylinder 3 by the moving belt 2 which serves to directly press the fabric 1 against the surface of the cylinder 3.

Under the pressure and temperature experienced by the fabric between the cylinder 3 and belt 2, moisture introduced into the fabric 1 in the moisturizing device is vapourised giving rise to a press steaming and shrinking caused by the application of a high contact pressure over a relatively great area of the fabric. The feel of fabric treated in this manner is comparable to the results of a conventional span or profile pressing plant. The great advantage of the present apparatus is that this result may now be obtained in a continuous operation.

By suitable setting of the temperatures of the cylinder 3 and the roller 2, a temperature difference can be set up across the fabric 1 as it is taken around the cylinder 3 by the belt 2.

Figure 3:
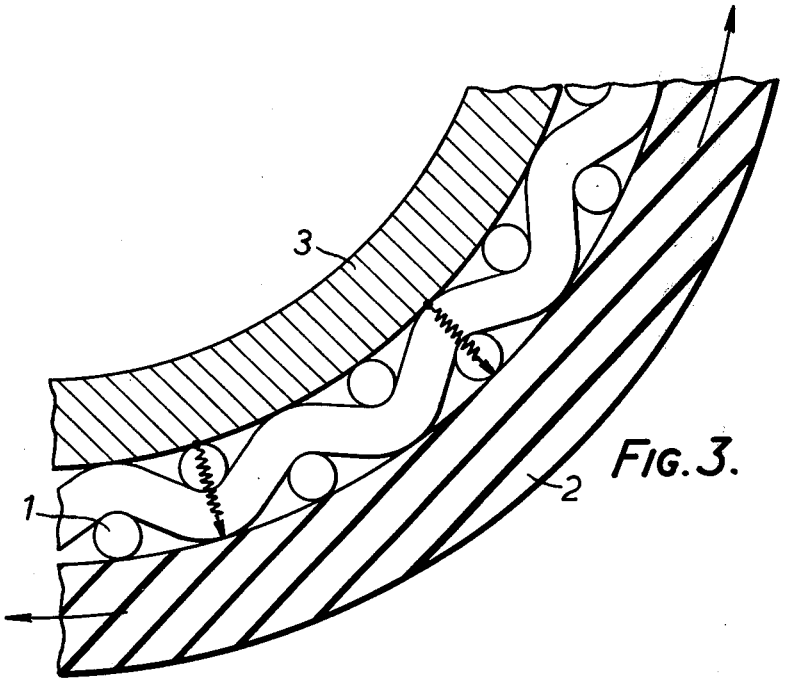
FIG. 3 is a section through part of a heatable cylinder of the apparatus showing a fabric under treatment being pressed against the cylinder by a pressure belt, the surface temperature of the cylinder being greater than that of the pressure belt.
Figure 4:
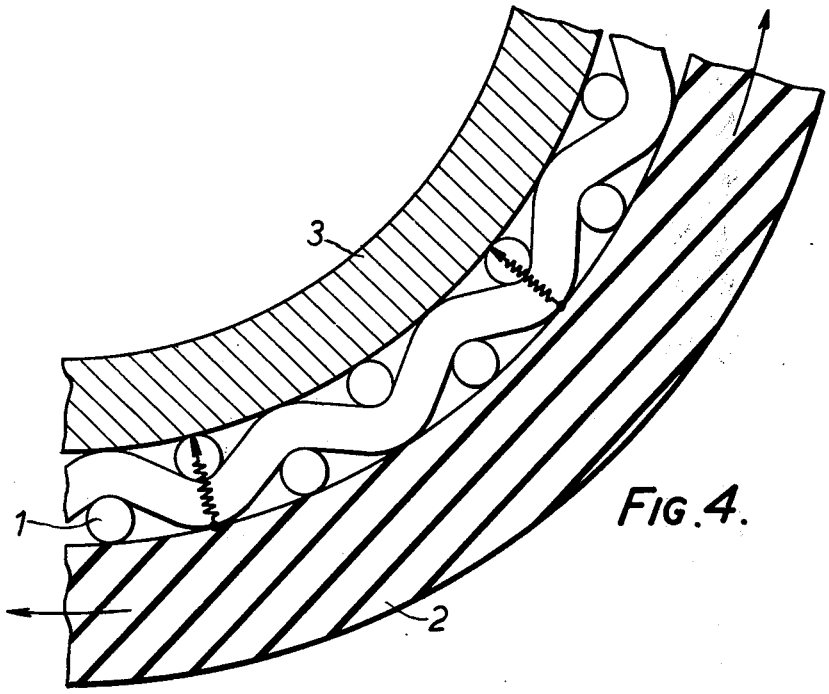
FIG. 4 is a section similar to FIG. 3 for the condition wherein the surface temperature of the heatable cylinder is lower than that of the pressure belt.

If, for example, the surface temperature of the cylinder 3 is selected to be 140° C. and higher than the surface temperature of the pressure belt 2, (at, for example, 90°–95° C.) condensation will preferentially occur on the side of the fabric 1 towards the pressure belt 2 under the specific contact pressure during the vapourisation of the moisture introduced into the fabric (see FIG. 3). The amount of moisture at the left-hand side of the fabric (underside) results in a lesser glazing action as compared to the right-hand side of the fabric which is pressed against the hotter cylinder 3. If, on the other hand, the surface temperature of the pressure belt is raised to 130° C. or 140° C. and the temperature of the cylinder is lowered to approximately 85 to 100° C., a reversed effect results (see FIG. 4).

The action of luster reduction under full pressing effect is useful in practice since higher contact pressures may be applied during pressing, without stretching or the so-called "greasy luster" becoming excessive. (It will be recalled that higher pressing thrusts tend to smooth and compact the fibrous structure of the fabric). The greater proportion of the press shine produced is transient and disappears during finish pressing.

In the prior art cylinder press system, the magnitude of the pressure which could be applied was not only limited by the need to avoid excessive luster but also by the fact that slip creases occurred suddenly in the fabric due to relative displacement between the stationary shell and the revolving press cylinder.

I claim:

1. In an apparatus for the continuous pressing and decatizing of cloth and fabric material, an arrangement comprising a rotatably-mounted, heatable cylinder, having a smooth surface, controllable first heating means arranged to heat said cylinder, a pressure belt in direct contact with material undergoing treatment to press said material into direct contact with the smooth surface of the cylinder, rollers for circulating the pressure belt, said rollers including a roller arranged upstream of the cylinder in the direction of belt circulation, second heating means arranged to heat the said upstream roller whereby to heat the pressure belt prior to passage around the heatable cylinder, control means for controlling the temperature of the second heating means independently of the first heating means whereby an adjustable temperature differential is set up across the material as it is pressed between the smooth surface of the cylinder and pressure belt, and a moisturizing device arranged upstream of the said cylinder to moisturize material prior to passage around the cylinder.

2. The arrangement as set forth in claim 1, in which the first and second heating means are steam heating means, each provided with a respective steam volume regulator, the steam regulator associated with the first heating means being controlled by a temperature regulator connected to a temperature sensor arranged to measure the surface temperature of the cylinder, and the steam regulator associated with the second heating means being controlled by a temperature regulator connected with a temperature sensor arranged to measure the surface temperature of the belt in the region of the cylinder.

3. The arrangement as set forth in claim 1, in which the moisturizing device has one or more steam boxes through which the material is moved.

4. The arrangement as set forth in claim 1, in which the moisturizing device has a steam cylinder through which the material is moved.

5. The arrangement as set forth in claim 1, including carrying rollers for moving the material through the moisturizing device, the rollers being arranged to be driven at independently settable speeds.

6. The arrangement as set forth in claim 5, including non-contact sensors arranged to control said carrying rollers in dependence on the speed of the material.

7. The arrangement as set forth in claim 1, including a carrying belt for carrying the said material through the moisturizing device.

8. The arrangement as set forth in claim 1, in which the roller of said belt circulating rollers arranged downstream of said cylinder in the direction of belt circulation, constitutes a belt drive roller.

9. The arrangement as set forth in claim 1, in which one said belt circulating rollers serves as a tensioning device for the belt.

* * * * *